US008820864B2

(12) United States Patent
Crookshanks et al.

(10) Patent No.: US 8,820,864 B2
(45) Date of Patent: Sep. 2, 2014

(54) REFRIGERATOR DRAWERS WITH TRIM

(75) Inventors: Kent Crookshanks, Anderson, SC (US); Charles D. Baker, Anderson, SC (US); Richard Brian Moulder, Anderson, SC (US); Paul D. Miller, Anderson, SC (US); Greg Wade, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 366 days.

(21) Appl. No.: 12/271,319

(22) Filed: Nov. 14, 2008

(65) Prior Publication Data

US 2010/0123379 A1 May 20, 2010

(51) Int. Cl.
*A47B 96/04* (2006.01)

(52) U.S. Cl.
USPC ..... 312/404; 312/213; 312/348.6

(58) Field of Classification Search
USPC ..... 312/404, 348.4, 348.6, 330.1, 213, 234, 312/234.1, 234.5, 348.1, 348.2, 31, 402; 62/382
See application file for complete search history.

(56) References Cited

U.S. PATENT DOCUMENTS

| | | | | | |
|---|---|---|---|---|---|
| 1,992,564 | A | * | 2/1935 | Amdur | 312/31 |
| 2,787,035 | A | | 4/1957 | Konefes | |
| 2,968,519 | A | * | 1/1961 | Weber | 312/204 |
| 3,107,389 | A | * | 10/1963 | Engelbrecht | 16/416 |
| 3,742,554 | A | * | 7/1973 | Houtman | 16/416 |
| 3,937,537 | A | * | 2/1976 | Dietterich | 312/404 |
| 4,379,603 | A | * | 4/1983 | Johnson et al. | 312/348.6 |
| 4,745,775 | A | * | 5/1988 | Bussan et al. | 62/382 |
| 5,016,946 | A | * | 5/1991 | Reznikov et al. | 312/108 |
| 5,040,856 | A | | 8/1991 | Wilkins et al. | |
| 5,161,870 | A | * | 11/1992 | Mason et al. | 312/348.4 |
| 5,165,771 | A | * | 11/1992 | Ballman et al. | 312/348.6 |
| 5,437,503 | A | | 8/1995 | Baker et al. | |
| 5,496,105 | A | * | 3/1996 | Czarnecky et al. | 312/334.4 |
| 5,540,492 | A | | 7/1996 | Dasher et al. | |
| 5,680,957 | A | * | 10/1997 | Liu | 220/663 |
| 5,951,133 | A | * | 9/1999 | Dittberner et al. | 312/348.4 |
| 5,951,134 | A | | 9/1999 | Braun et al. | |

(Continued)

FOREIGN PATENT DOCUMENTS

| | | | |
|---|---|---|---|
| CN | 201062915 | | 5/2008 |
| DE | 4033379 | A1 * | 4/1992 |
| DE | 4304484 | | 8/1994 |
| EP | 611931 | A1 * | 8/1994 |

OTHER PUBLICATIONS

Partial International Search Report for PCT/US2009/064316 dated Jan. 20, 2011, 2 pages.

*Primary Examiner* — Darnell Jayne
*Assistant Examiner* — Andres F Gallego
(74) *Attorney, Agent, or Firm* — Pearne & Gordon LLP

(57) ABSTRACT

An appliance that includes a storage compartment includes either a drawer or a wire basket located in the storage compartment, a handle, and a trim portion. The drawer or basket stores at least one item and the drawer is movable relative to the storage compartment. The handle is snappingly secured to a peripheral edge of the drawer or basket. The trim portion is snappingly secured to at least one edge of the drawer or basket where the trim portion is secured independently of the handle. In another example, a humidity control device is located on the drawer and controls the humidity within the interior portion of the drawer. A knob that controls the humidity control device is received through a cutout in the trim portion.

14 Claims, 5 Drawing Sheets

(56) References Cited

U.S. PATENT DOCUMENTS

| | | | | |
|---|---|---|---|---|
| 5,997,118 | A * | 12/1999 | McBrayer et al. | 312/334.44 |
| D512,446 | S | 12/2005 | Ertz | |
| 7,028,503 | B2 | 4/2006 | Lyvers et al. | |
| 2003/0020384 | A1 | 1/2003 | Bush et al. | |
| 2005/0093408 | A1 | 5/2005 | Koloff, Jr. et al. | |
| 2006/0017360 | A1 | 1/2006 | Lyvers et al. | |
| 2006/0082270 | A1 | 4/2006 | Collins et al. | |
| 2006/0152118 | A1 | 7/2006 | Lee | |
| 2008/0054772 | A1* | 3/2008 | Koloff et al. | 312/404 |
| 2009/0153006 | A1* | 6/2009 | Hazzard et al. | 312/348.4 |
| 2011/0146334 | A1* | 6/2011 | Kim et al. | 62/441 |

* cited by examiner

REFRIGERATOR DRAWERS WITH TRIM

BACKGROUND OF THE INVENTION

The present invention relates generally to drawers for an appliance. In particular, the invention relates to securing a trim portion and a handle to a drawer.

It is generally known in the prior art to provide drawers in a storage compartment of an appliance, such as a refrigerator. Conventional drawers have included a trim portion attached to a drawer. Typical trim portions can cover the top edge, the bottom edge, and the opposite edge edges of a front wall of the drawer. Conventional drawers can also include a crisper drawer with a humidity control device. However, it is desirable to provide a handle that can be secured to the drawer in combination with a trim portion for a variety of reasons, such as, for example, providing the handle for the drawer where the drawer does not already include the handle. Thus, it may still be desirable to provide a trim portion separated from a handle such that a user can provide the trim portion and the handle of their desire for the drawer. In addition, it is also desirable to provide a trim portion that can be used with a humidity control device, such as on a crisper trim.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, an appliance that includes a storage compartment is provided. The appliance comprises a drawer located in the storage compartment, a handle, and a trim portion. The drawer is configured for storing at least one item and the drawer is movable relative to the storage compartment. The handle is snappingly secured to a peripheral edge of the drawer. The trim portion is snappingly secured to at least one edge of the drawer wherein the trim portion is secured independently of the handle.

In accordance with another aspect of the present invention, an appliance that includes a storage compartment is provided. The appliance comprises a wire basket located in the storage compartment, a trim portion, a window portion, and a handle. The wire basket is configured for storing at least one item and the wire basket is movable relative to the storage compartment. The trim portion is snappingly secured to at least one edge of the wire basket. The window portion is inserted into the trim portion and the window portion is configured to prevent access to a front opening of the wire basket. The handle is snappingly secured to a peripheral edge of the window portion of the wire basket. The trim portion is secured independently of the handle.

In accordance with another aspect of the present invention, an appliance that includes a storage compartment is provided. The appliance comprises a drawer located in the storage compartment, a handle, a trim portion, and a humidity control device. The drawer is configured for storing at least one item and the drawer is movable relative to the storage compartment. The handle is snappingly secured to a front edge of the drawer. The trim portion is snappingly secured to at least one edge of the drawer where the trim portion is secured independently of the handle. The humidity control device is located on the drawer and is configured to control the humidity within the interior portion of the drawer. The drawer includes a humidity vent. The humidity control device includes a panel between the drawer and the trim portion and a knob protruding from the panel. The knob is movable to control an amount of the panel that is blocking the humidity vent. The knob is received through a cutout in the trim portion.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
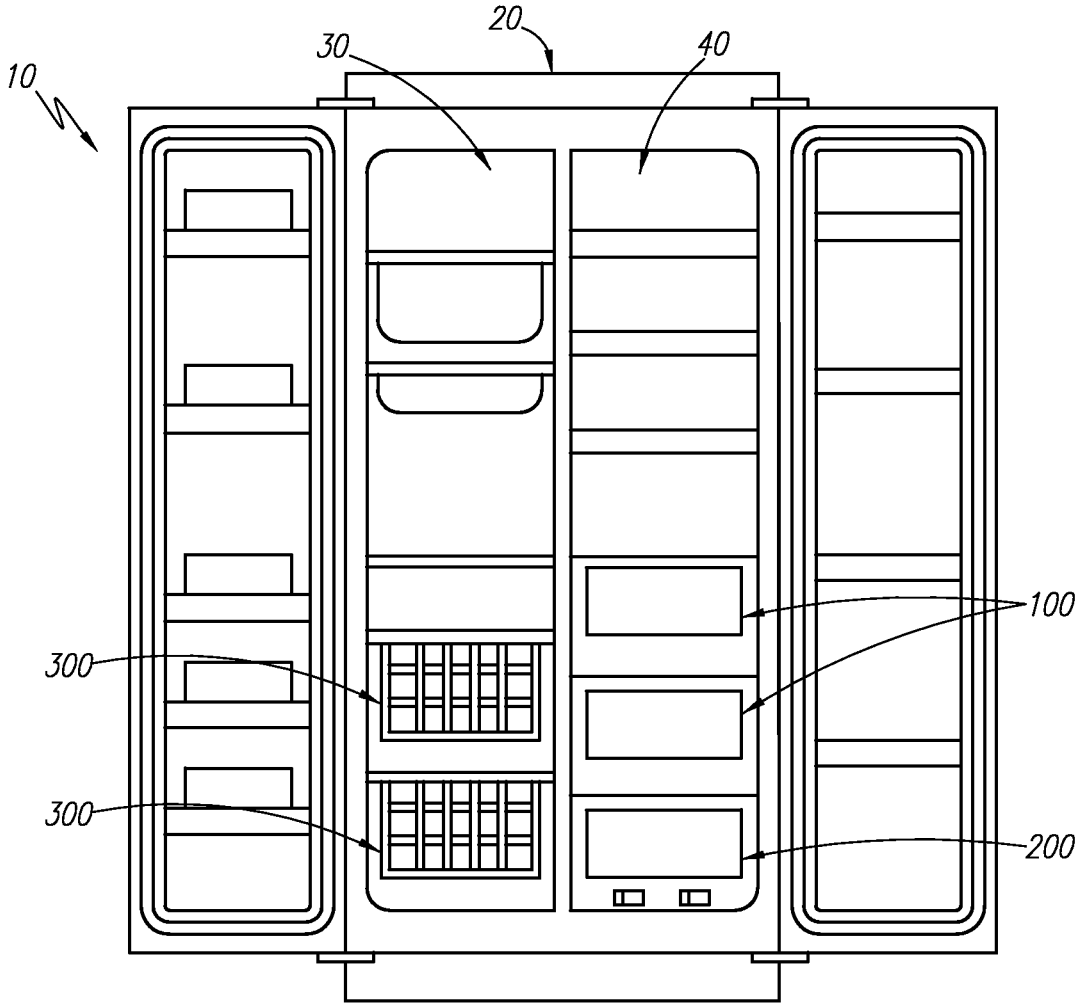
FIG. 1 is a front view of an example appliance that includes a storage compartment and a first example drawer, a second example drawer, and a third example basket.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

An appliance 10 that includes the subject invention is shown in FIG. 1. The appliance 10 in this example is a refrigerator. The refrigerator includes a storage compartment 20 that can be used to store objects for cooling. The storage compartment 20 can include a freezer compartment 30 and a refrigerator compartment 40. The appliance can include a first example, second example, or third example of the subject invention. The first example of the subject invention can be a drawer 100. The second example of the subject invention can be a drawer 200. The third example of the subject invention can be a basket 300. The variety of drawers 100, 200 or baskets 300 in at least one of the storage compartments 30, 40 can be used to store various items, such as food items.

Figure 2:
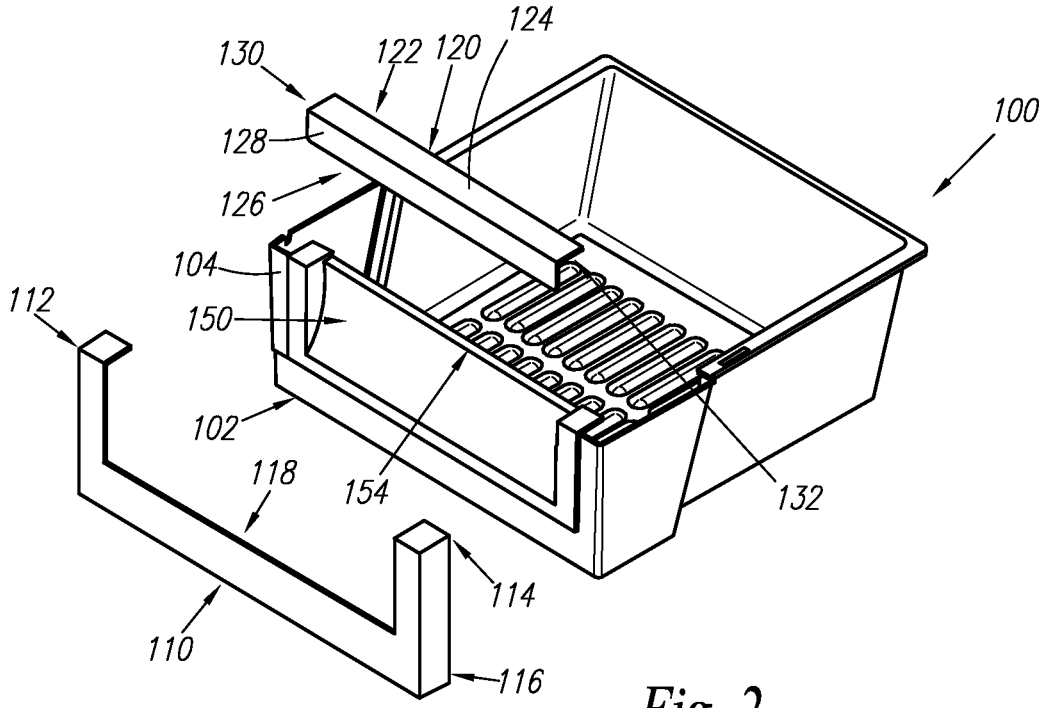
FIG. 2 is a perspective view of an assembly of the first example drawer of FIG. 1.
Figure 3:
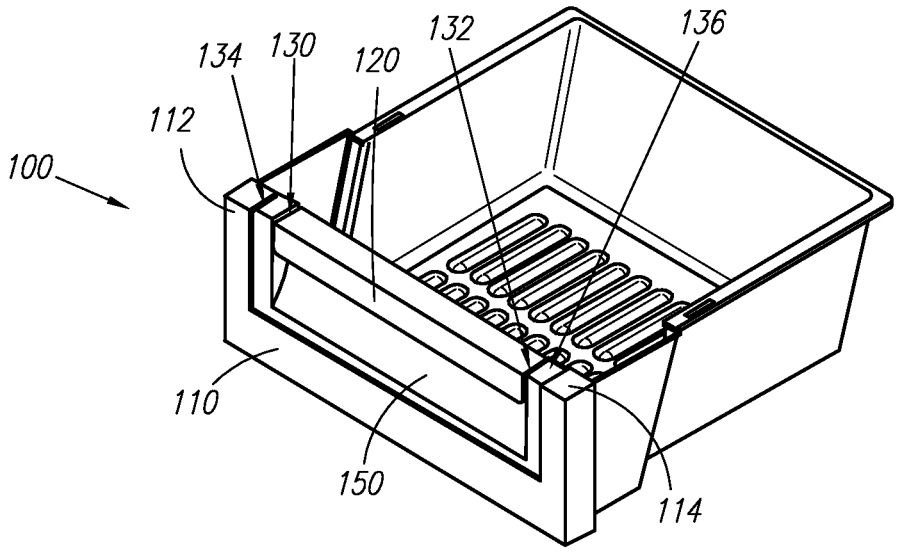
FIG. 3 is a perspective view with the first example drawer of FIG. 2 fully assembled.

A first example of a drawer 100 of the subject invention that is used in the appliance of FIG. 1 is shown in FIGS. 2-4. The drawer 100 can be a one-piece bin, such as a crisper drawer. An attachable trim portion 110 and a separate attachable handle 120 can be attached on to the drawer 100 so that handle is removable from the drawer while the trim portion is secured to the drawer. The trim portion 110 can be a decorative U-shaped portion, as shown in this example. In the example of FIG. 2, a U-shaped area 118 is bounded by the U-shape of the trim portion 110. The trim portion 110 and the handle 120 also allow a user to add color and a decorative look to the drawer 100 or basket 300. The trim portion 110 can also include a first end 112 and a second end 114. In addition, the trim portion 110 can have other orientations for the U-shape. Furthermore, other shapes for the trim portion 110 can also be provided. The trim portion 110 can have a side portion 116 that is configured to also conceal or cover a portion of a first side 102 of the drawer 100. The trim portion 110 can then be snappingly secured to at least one peripheral edge of the drawer 100, such as an edge 104 facing the first side 102. FIG. 3 shows the example of FIG. 2 with the handle 120 and the U-shaped trim portion 110 attached to the drawer 100.

As shown in FIG. 2, the drawer 100 can further include a window portion 150. The window portion 150 can be formed as part of the drawer 100 during the manufacture of the drawer 100. The window portion 150 can be substantially transparent. The window portion 150 is located within the U-shaped area such that a user can attach the trim portion 110 without obstructing the window portion 150 or the view of the items within the drawer 100. The handle 120 and trim portion 110 have coplanar front surfaces and the window portion 150 is inset behind the coplanar front surfaces.

In the example of FIG. 2, the handle 120 is attached on the window portion 150 of the drawer 100. The window portion 150 can include a peripheral edge, such as the top peripheral edge 154, a substantially different shape than the shape or profile of the handle 120. For example, the top peripheral edge 154 of the window portion 150 can be substantially smaller than a top edge portion 124 of the handle 120. Thus, the handle 120 provides a handle for a drawer that does not already include a handle. In further examples, the handle 120 can provide an improved structure for grasping the drawer. In other examples, the handle 120 can be attached on the first side 102 of the drawer 100, such as on a top peripheral edge of the drawer 100, regardless of whether a window portion 150 is provided. The peripheral edge of the drawer 100 can have a shape or profile that is substantially different than the shape or profile of the handle 120. For example, the top peripheral edge of the drawer 100 can be substantially smaller than a top edge portion 124 of the handle 120. The handle 120 can thus be configured to snap on to surfaces of varying dimensions to provide a user with an easily accessible way to control the movement of the drawer 100. In this example, the handle 120 provides an ergonomic solution for the window portion 150, as the handle 120 is configured to be grasped by a user.

The trim portion 110 and the handle 120 can be attached on the first side 102 of the drawer 100, such as the first side 102 facing a user of an appliance 10. The handle 120 can be attached independent of the attachment assembly of the trim portion 110 to the first side 102 of the drawer 100. Thus, the handle 120 and the trim portion 110 are both independently exchanged without interference between each other. The handle 120 can include a first portion 122 that can include the top edge portion 124 and the handle 120 can further include a second portion 126 that can include a front edge 128. The second portion 126 can extend downwards such that the handle 120 is configured to be grasped in a space between the second portion 126 and the drawer 100 or window portion 150 to move the drawer 100 relative to the storage compartment 20, such as in or out of the storage compartment 20. The handle 120 can also further include a first handle end 130 and a second handle end 132.

As shown in FIG. 3, upon the attachment of the handle 120 to the drawer 100 and the attachment of the trim portion 110 to the drawer 100, a first gap 134 can be provided between the first handle end 130 and the first end 112 of the trim portion 110. The attachment of the handle 120 to the drawer 100 and the attachment of the trim portion 110 to the drawer 100 can also provide a second gap 136 can be provided between the second handle end 132 and the second end 114 of the trim portion 110.

Figure 4A:
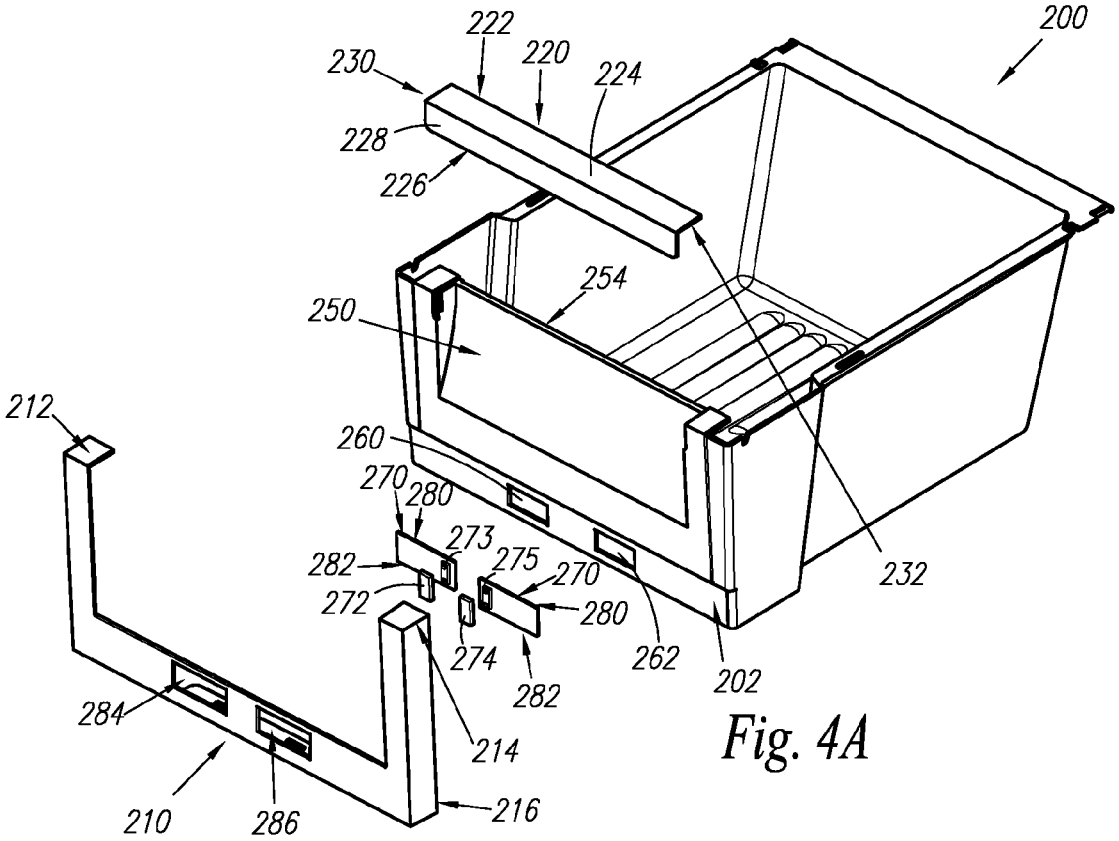
FIG. 4A is a first perspective view of an assembly of the second example drawer of FIG. 1.
Figure 5:
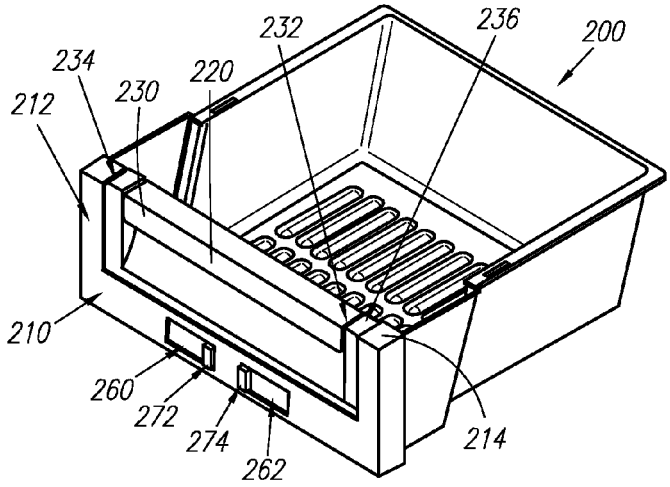
FIG. 5 is a perspective view with the second example drawer of FIG. 4 fully assembled.

FIG. 4A illustrates a second example of the subject invention where a drawer 200, such as a crisper drawer, is provided. The drawer 200 is similar in many respects to the drawer 100 described in FIG. 2 and FIG. 3. For example, the drawer 200 includes an attachable trim portion 210 and a separate attachable handle 220 that can be attached on to the drawer 200. The trim portion 210 can be a decorative U-shaped portion, as shown in this example. In the example of FIG. 4A, a U-shaped area 218 is bounded by the U-shape of the trim portion 210. The trim portion 210 and the handle 220 also allow a user to add color and a decorative look to the drawer 200 or basket 300. The trim portion 210 can also include a first end 212 and a second end 214. In addition, the trim portion 210 can have other orientations for the U-shape. Furthermore, other shapes for the trim portion 210 can also be provided. The trim portion 210 can have a side portion 216 that is configured to also conceal or cover a portion of a first side 202 of the drawer 200. The trim portion 210 can then be snappingly secured to at least one peripheral edge of the drawer 200, such as an edge 204 facing the first side 202. FIG. 5 shows the example of FIG. 4A with the handle 220 and the U-shaped trim portion 210 attached to the drawer 200.

As shown in FIG. 4A, the drawer 200 can further include a window portion 250. The window portion 250 can be formed as part of the drawer 200 during the manufacture of the drawer 200. The window portion 250 can be substantially transparent. The window portion 250 is located within the U-shaped area such that a user can attach the trim portion 210 without obstructing the window portion 250 or the view of the items within the drawer 200.

In the example of FIG. 4A, the handle 220 is attached on the window portion 250 of the drawer 200. A top peripheral edge 254 of the window portion 250 can be substantially smaller than the top edge 224 of the handle 220, as described above regarding FIG. 2. In other examples, the handle 220 can be attached on the first side 202 of the drawer 200, such as on a top peripheral edge of the drawer 200, regardless of whether a window portion 250 is provided. The peripheral edge of the drawer 200 can have a shape or profile that is substantially different than the shape or profile of the handle 220. The handle 220 can thus be configured to snap on to surfaces of varying dimensions to provide a user with an easily accessible way to control the movement of the drawer 200. In this example, the handle 220 provides an ergonomic solution for the window portion 250, as the handle 220 is configured to be grasped by a user.

The trim portion 210 and the handle 220 can be attached on the first side 202 of the drawer 200, such as the first side 202 facing a user of an appliance 10. The handle 220 can be attached independent of the attachment assembly of the trim portion 210 to the first side 202 of the drawer 200. Thus, the handle 220 and the trim portion 210 are both independently exchanged without interference between each other. The handle 220 can include a first portion 222 that can include the top edge 224 and the handle 220 can further include a second portion 226 that can include a front edge 228. The second portion 226 can extend downwards such that the handle 220 is configured to be grasped in a space between the second portion 226 and the drawer 200 or window portion 250 to move the drawer 200 relative to the storage compartment 20, such as in or out of the storage compartment 20. The handle 220 can also further include a first handle end 230 and a second handle end 232.

As shown in FIG. 5, upon the attachment of the handle 220 to the drawer 200 and the attachment of the trim portion 210 to the drawer 200, a first gap 234 can be provided between the first handle end 230 and the first end 212 of the trim portion 210. The attachment of the handle 220 to the drawer 200 and the attachment of the trim portion 210 to the drawer 200 can also provide a second gap 236 can be provided between the second handle end 232 and the second end 214 of the trim portion 210.

As shown in FIG. 4A, the drawer 200 includes at least one humidity vent, such as a first humidity vent 260 and a second humidity vent 262. While a plurality of humidity vents are shown in this example, it is appreciated that in other examples, other numbers of humidity vents can be provided, such as by providing just one humidity vent. The humidity vents are configured to help control the humidity within the interior portion of the drawer 200. In this example, a humidity control device is provided by a panel 270 which is sandwiched between the drawer 200 and the trim portion 210. The panel 270 of the humidity control device includes at least one knob. In this example, a first knob 272 and a second knob 274 are provided on two different panels 270. It is appreciated that each panel 270 functions in the same manner, so just one panel will be described. The first knob 272 is configured to be secured to the panel 270 at a mounting portion 273. A second mounting portion 275 can be used for the second knob 274. Each mounting portion 273, 275 can secure each knob 272, 274 through a snapping mechanism or other suitable attachment device. Each knob 272, 274 protrudes outwards from each panel 270. Movement of the knob 272, 274 controls the amount that the panel 270 blocks the first humidity vent 260 or the second humidity vent 262 of the drawer 200. The amount that the panel 270 is blocking the humidity vent controls the humidity by regulating the respective air flow that can reach the interior of the drawer 200.

Figure 4B:
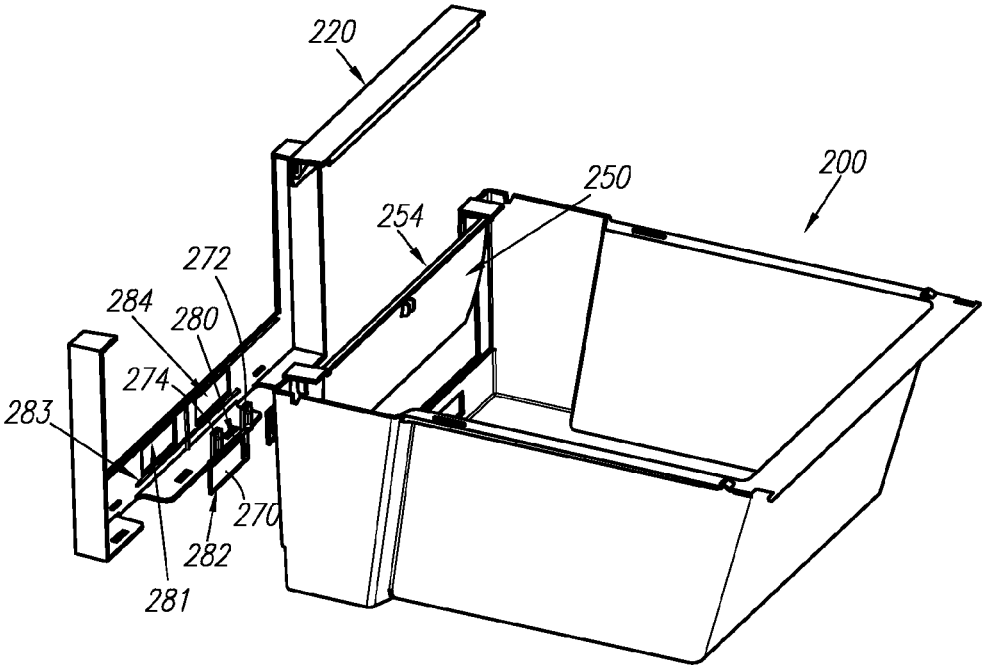
FIG. 4B is a second perspective view of an assembly of the second example drawer of FIG. 1.

As shown in FIG. 4B, each panel 270 can be received by the trim portion 210 where the at least one knob 272 is attached to a panel 270. The movement of the panel 270 within the trim portion 210 controls the humidity for the drawer. Alternatively, the knob 272 can be connected to a series of vanes that can be closed or opened to control the amount of air that can enter and leave the drawer 200. The trim portion 210 can further include at least one cutout, such as a first cutout 284 and a second cutout 286 that are configured to correspond to the first humidity vent 260 and a second humidity vent 262. Moreover, the first cutout 284 and the second cutout 286 are configured to receive the knobs of the humidity control device. In other examples, other forms of control from the drawer can be received by the cutouts 284, 286. Accordingly, a user can attach the trim portion 210 to a drawer 200 with a humidity control device while still being able to control the amount of humidity within the drawer 200. Once assembled, the knob can be grasped and is slidable to control the opening into the interior area of the bin. In this example, the knob is movable left or right though other orientations can be used. A handle 220 can provide or improve the ability of a user to grasp the drawer 200. The handle 220 and the trim portion 210 are both independently exchanged without interference between each other.

The trim portion 210 can also include a first rib 281 and a second rib 283 that are configured to trap an upper edge 280 and a lower edge 282 of each panel 270 of each humidity control device. For example, the first rib 281 and the second rib 283 can be configured to slidingly receive the upper edge 280 and the lower edge 282 of each panel 270. Accordingly, the trim portion 210 can be configured to removably receive a humidity control device. In further examples, the drawer 200 can already be provided with an assembled humidity control device, such that a user only needs to attach the trim portion 210 with the at least one cutout to the drawer 200. Alternatively, the first rib 281 and the second rib 283 can provide other forms of attachment for the panel 270, such as a snapping connection. An assembled view of the drawer 200 with humidity vents 260, 262 is shown in FIG. 5.

Figure 6:
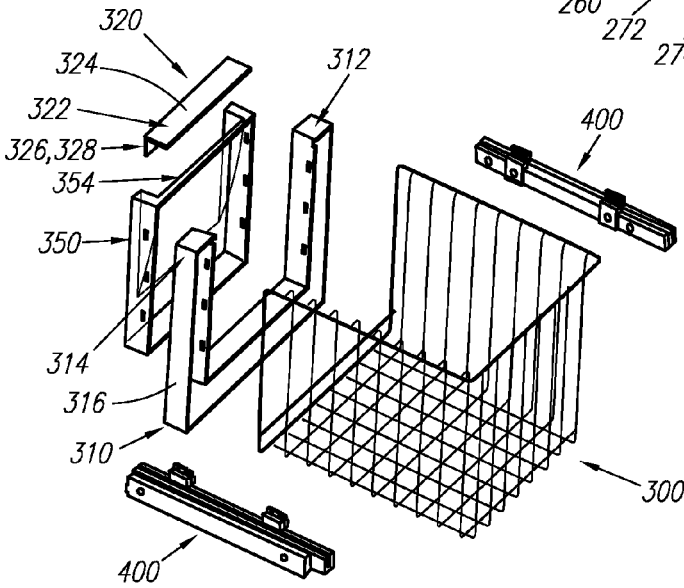
FIG. 6 is a perspective view of an assembly of the third example basket of FIG. 1.
Figure 7:
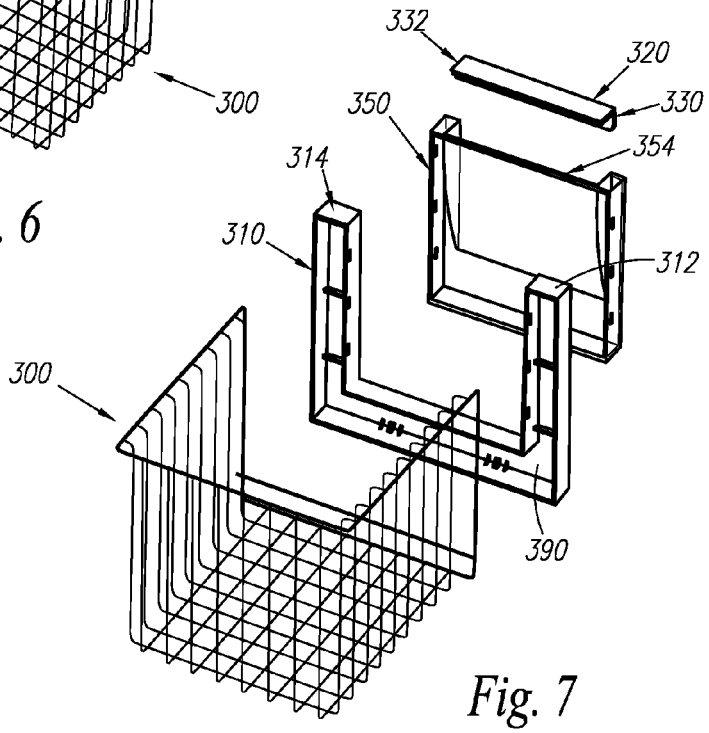
FIG. 7 is a second perspective view of the third example basket of FIG. 6.
Figure 8:
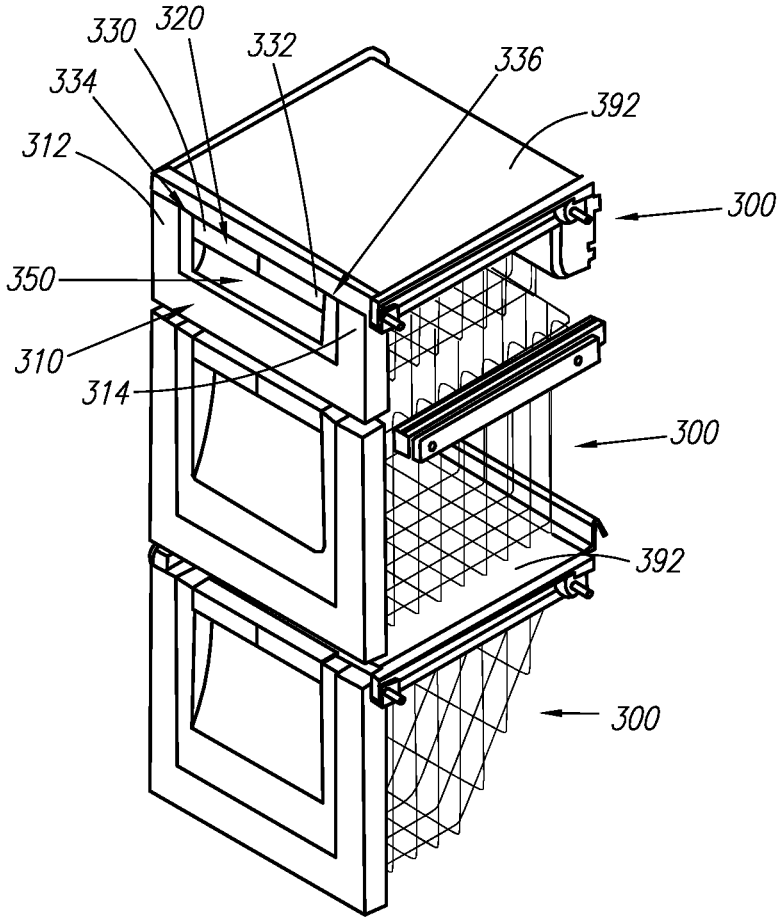
FIG. 8 is a perspective view with the third example basket of FIG. 6 fully assembled.

A third example of the subject invention is shown in FIGS. 6-8. In the third example, wire baskets 300 instead of drawers 100, 200 are utilized. An attachable trim portion 310 and a separate attachable handle 320 can be attached on to the basket 300. The trim portion 310 and the handle 320 are similar in many respects to the corresponding structures found on the drawers 100, 200 described in FIG. 2 and FIG. 3. In the example of FIG. 6, a plurality of sliding mechanisms 400 and a window portion 350 can also be provided. The sliding mechanisms 400 can comprises a series of rails which can be attached to the inner walls of the storage compartment 20, such as the freezer compartment 30. The wire baskets 300 can be located within the freezer compartment 30 shown in FIG. 1. The baskets can be wire baskets 300 having an open top portion and an open front portion, as shown in FIG. 6 and FIG. 7. The trim portion 310 can be a decorative U-shaped portion, as shown in this example. The trim portion 310 can also include a first end 312 and a second end 314. In addition, the trim portion 310 can have other orientations for the U-shape. Furthermore, other shapes for the trim portion 310 can also be provided. The trim portion 310 can have a side portion 316 that is configured to also conceal or cover a portion of a first side 302 of the basket 300. The trim portion 310 can be attached at the open front portion of the basket 300.

As shown in FIG. 6, the window portion 350 can be inserted into the U-shaped area bounded by the trim portion 310 such that the window portion 350 is configured to prevent access to the front opening of the basket 300. The window portion 350 can be substantially transparent. The handle 320 can be attached independent of the attachment assembly of the trim portion 310 to the front side of the basket 300. The handle 320 and the trim portion 310 are both independently exchanged without interference between each other. The handle 320 can include a first portion 322 that can include a top edge portion 324 and the handle 320 can further include a second portion 326 that can include a front edge 328. The second portion 326 can extend downwards such that a user can grasp the second portion 326 in a space located between the second portion 326 and the basket 300 or the window portion 350 to move the basket 300 relative to the storage compartment 20, such as in or out of the storage compartment 20. The handle 320 can be separately attached to the window portion 350, such as on to a top peripheral edge 354 of the window portion 350 that is substantially smaller than the top edge portion 324 of the handle 320. The handle 320 can thus be configured to snap on to surfaces of varying dimensions to provide a user with an easily accessible way to control the movement of the basket 300. In other examples, the basket 300 can be provided with a bar on the front portion of the basket 300 for attachment of the handle 320 to the wire basket. The bar of the basket 300 can have a shape or profile that is substantially different than the shape or profile of the handle 320. For example, the basket 300 can have a top edge portion that is substantially smaller than a top edge portion of the handle 320. The handle 320 can thus be configured to snap on to surfaces of varying dimensions to provide a user with an easily accessible way to control the movement of the basket 300.

In the example shown in FIG. 7, the trim portion 310 includes a recessed surface 390 that is configured for attachment to the front portion of the basket 300. The recessed surface 390 can include structure configured to receive the wire members of the basket 300. The first rib and the second rib of FIG. 4 can also be seen in FIG. 7, where the upper side and the lower side have distinct edges that are perpendicular in orientation to the recessed surface 390 such that the ribs can be contacted. The trim portion 310 can be a decorative U-shaped portion, as shown in this example. In the example of FIG. 7, a U-shaped area is bounded by the U-shape of the trim portion 310. The window portion 350 can be located within the U-shaped area such that a user can insert the window portion 350 within the U-shaped area. In addition, there can be a snapping engagement between the window portion 350 and the trim portion 310. Alternatively, fasteners can be provided to attach the window portion 350 to the trim portion 310.

FIG. 8 shows the second example of FIG. 7 fully assembled. FIG. 8 also shows that a plurality of baskets 300 can be provided one on top of the other where each basket 300 includes a trim portion 310 and a handle 320. Moreover, a cover 392 can be provided on the top of some of the baskets 300 for the purpose of making it easier for a user to visually identify what is in each individual basket 300. Each cover 392 can be attached to the top surface of a basket 300 or snappingly secured to the top surface of a basket 300.

As shown in FIG. 8, the handle 320 can also further include a first handle end 330 and a second handle end 332. Upon the attachment of the handle 320 to the basket 300 and the attachment of the trim portion 310 to the basket 300, a first gap 334 can be provided between the first handle end 330 and the first end 312 of the trim portion 310. The attachment of the handle 320 to the basket 300 and the attachment of the trim portion 310 to the basket 300 can also provide a second gap 336 can be provided between the second handle end 332 and the second end 314 of the trim portion 310.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An appliance that includes a storage compartment comprising:

a drawer located in the storage compartment wherein the drawer is configured for storing at least one item and the drawer is movable relative to the storage compartment, wherein the drawer includes a front face;

a handle snappingly secured to a peripheral edge of the drawer, the handle including a first handle end and a second handle end;

a trim portion snappingly secured to at least one edge of the drawer wherein the trim portion is secured independently of the handle, the trim portion including a first end and a second end; and a window defined by the drawer, wherein the window is inset from the front face, wherein each of the handle and the trim portion is separately removable from the drawer independent of the other of the handle and trim portion, such that the trim portion and the handle are attached to the drawer at separate, non-overlapping locations from each other, wherein the handle and the trim portion at least partially define both a first gap between the first handle end and the first end of the trim portion and a second gap between the second handle end and the second end of the trim portion.

2. The appliance according to claim 1, wherein the trim portion is U-shaped.

3. The appliance according to claim 1, wherein the handle has a substantially different shape than the peripheral edge that the handle is snappingly secured to.

4. The appliance according to claim 1, wherein the peripheral edge of the window portion is the peripheral edge of the drawer that the handle is snappingly secured to.

5. The appliance according to claim 1, wherein the handle includes a first portion and a second portion;

wherein the handle is configured to be grasped in a space between the second portion and the drawer for movement relative to the storage compartment.

6. An appliance that includes a storage compartment comprising:

a drawer located in the storage compartment wherein the drawer is configured for storing at least one item and the drawer is movable relative to the storage compartment, wherein the drawer includes a front face;

a handle snappingly secured to a front edge of the drawer;

a trim portion snappingly secured to at least one edge of the drawer wherein the trim portion is secured independently of the handle, wherein a rear surface of the trim portion includes at least one rib that extends towards the drawer;

a window defined by the drawer, wherein the window is inset from the front face; and a humidity control device located on the drawer configured to control a humidity within an interior portion of the drawer;

wherein the drawer includes a humidity vent, wherein the humidity vent is located below the window and is inset from the front face;

wherein the humidity control device includes a panel between the drawer and the trim portion and the humidity control device further includes a knob protruding from the panel, wherein an edge of the panel is configured to slidingly contact the at least one rib such that the at least one rib is configured to slidingly receive the at least one edge of the panel;

wherein the trim portion includes at least one cutout configured to correspond to the humidity vent, wherein the knob is movable to control an amount of the panel that is blocking the humidity vent; and wherein the knob is received through the cutout in the trim portion.

7. The appliance according to claim 6, wherein the handle has a substantially different shape than a top edge of a peripheral edge that the handle is snappingly secured to.

8. The appliance according to claim 7, wherein a peripheral edge of the window portion is the peripheral edge of the drawer that the handle is snappingly secured to.

9. The appliance according to claim 6, wherein the at least one rib of the trim portion includes a first rib and a second rib that are configured to trap an upper edge and a lower edge of the panel.

10. The appliance according to claim 9, wherein the first rib extends along a first edge of the cutout and the second rib extends along an opposite second edge of the cutout, further wherein the panel is configured to slidingly contact the first rib and the second rib.

11. The appliance according to claim 6, wherein the trim portion is U-shaped.

12. The appliance according to claim 6, wherein the trim portion includes a first end and a second end;

wherein the handle includes a first handle end and a second handle end;

wherein the handle is snappingly secured to the drawer with a gap between each end of the handle and each end of the trim portion.

13. The appliance according to claim 6, wherein the handle includes a first portion and a second portion;

wherein the handle is configured to be grasped in a space between the second portion and the drawer for movement relative to the storage compartment.

14. The appliance according to claim 6, wherein the trim portion and the handle are attached to the drawer at separate locations not in contact with each other.

* * * * *